United States Patent [19]

Bender et al.

[11] 4,029,565

[45] June 14, 1977

[54] ELECTROLYTIC APPARATUS

[75] Inventors: Werner Bender, Hofheim, Taunus; Dieter Bergner; Kurt Hannesen, both of Kelkheim, Taunus; Helmut Hund, Konigstein, Taunus; Wilfried Schulte, Hofheim/Taunus, all of Germany

[73] Assignee: Hoeschst Aktiengesellschaft, Frankfurt am Main, Germany

[22] Filed: Aug. 27, 1976

[21] Appl. No.: 718,341

[30] Foreign Application Priority Data

Aug. 29, 1975 Germany ..... 2538414
Mar. 11, 1976 Germany ..... 2610114

[52] U.S. Cl. ..... 204/256; 204/252; 204/258; 204/266

[51] Int. Cl.[2] ..... C25B 1/26; C25B 9/00

[58] Field of Search ..... 204/252, 253, 254, 256, 204/258, 266

[56] References Cited

UNITED STATES PATENTS

| | | | |
|---|---|---|---|
| 1,263,314 | 4/1918 | Emanuel | 204/278 |
| 3,649,511 | 3/1972 | Danly et al. | 204/252 |
| 3,673,076 | 6/1972 | Jucknieß | 204/256 |
| 3,864,236 | 2/1975 | Lindstrom | 204/265 |

*Primary Examiner*—Arthur C. Prescott
*Attorney, Agent, or Firm*—Curtis, Morris & Safford

[57] ABSTRACT

In an electrolytic apparatus for the production of chlorine from aqueous alkali metal chloride solution, comprising at least one electrolytic cell with equipment for the supply of the current, the supply of the starting product and the discharge of the products of electrolysis and a separating wall for separating the anode and cathode, the housing of the cell is composed of two hemispherical shells, the electrodes are connected with the hemispherical shells by conductive bolts projecting through the wall of the shells and the projecting end faces of the bolts are in contact with current supply means and means to clamp together the supply means, the shells, the electrodes and the separating wall, which wall is positioned between electrically insulating spacers mounted in the extension of the bolts on the electrolytically active side of the electrodes and clamped between the edges of the hemispherical shells by packing elements.

9 Claims, 5 Drawing Figures

Figure 1:
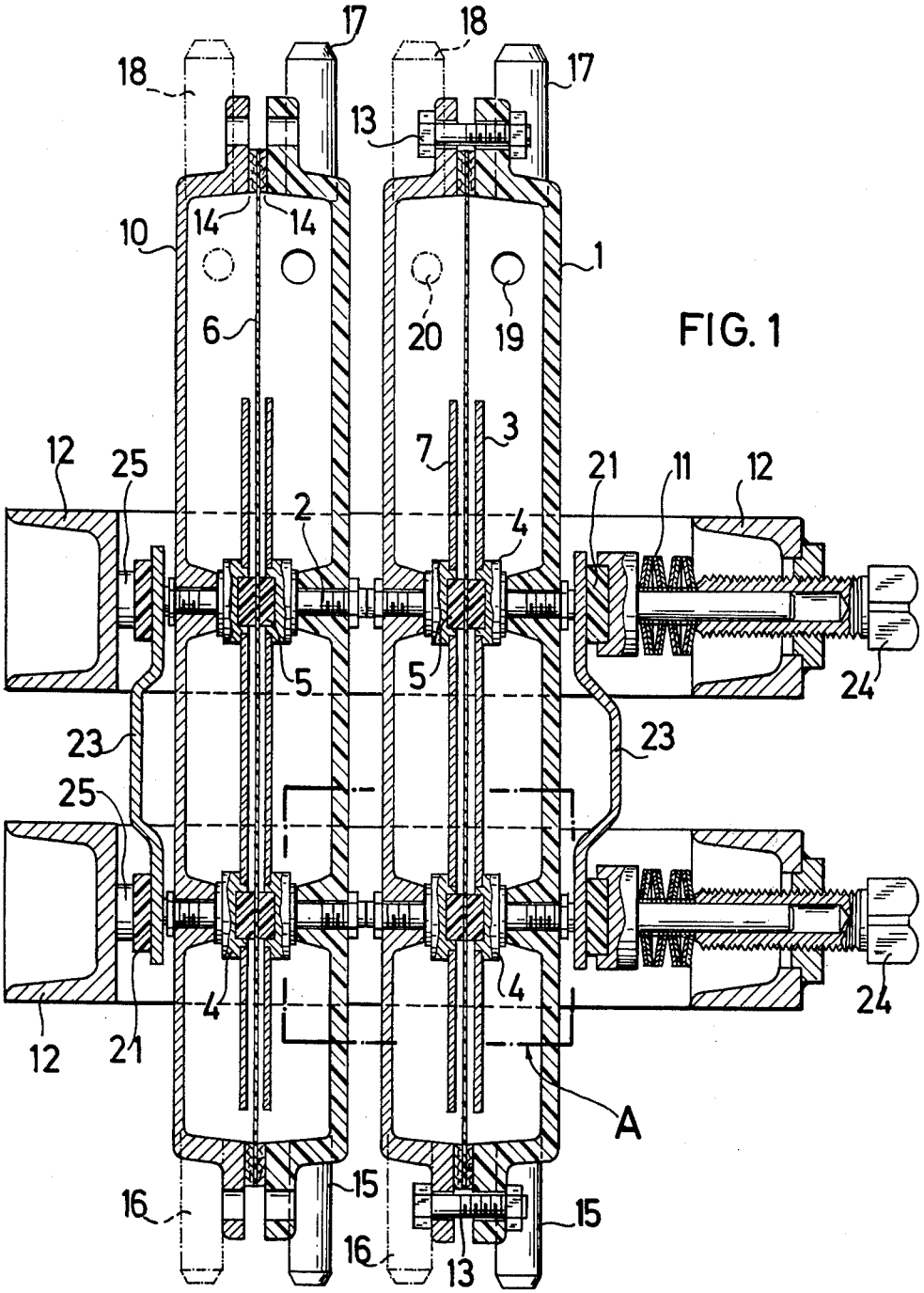

17
18
18
17
13
14
14
10
1
6
20
19

12
25
7
3
21
11
12
2
4
5
5
24
23
23
25
4
4
24
12
21
A
16
15
15
16
13

ELECTROLYTIC APPARATUS

This invention relates to an electrolytic apparatus for the production of chlorine from aqueous alkali metal chloride solution, in which apparatus the anode space is separated from the cathode space by a separating wall, for example a diaphragm or an ion exchange membrane.

German Auslegeschrift No. 1,421,051 discloses a multiple electrolytic cell in which an asbestos diaphragm is mounted between the graphite or platinum metal anodes and the metal cathodes. Diaphragm, metal cathode and anode form a so-called assembly unit which is spaced from the adjacent unit by a frame. To provide for the space necessary for the catholyte part of the cathode close to the anode carries nipples supporting the diaphragm mounted on a metal gauze sieve.

German Offenlegungsschrift No. 2,100,214 proposes a similar multiple electrolytic cell in which the metal electrodes provided with nipples are welded together in pairs and adjacent pairs of electrodes are separated from one another by a diaphragm. The diaphragm rests upon the nipples of opposite electrodes. The anolyte and catholyte circulate in the channels thus formed.

Known multiple electrolytic cells have the disadvantage that to eliminate breakdowns, for example leakages between the individual elements, damages on the electrodes or the separating wall, the electrolytic cell must be emptied and then filled again, which operations take much time and are quite expensive. In most cases it is impossible to localize the site of breakdown without complete dismounting of the apparatus and to put the apparatus to operation again without complete dismounting and complete renewal of the individual packings of the elements.

A further drawback resides in the fact that it is not possible to discharge rapidly enough the generated gas from the active electrode surface. Separate channels for the gas removal are not possible so that the anolyte and catholyte must be degassed after having left the electrolyte apparatus. In the case of an explosion, which cannot be excluded with this type of electrolysis, the entire electrolytic apparatus is generally destroyed.

It is, therefore, the object of the invention to provide an electrolytic apparatus which does not have the aforesaid disadvantages. It is the further object of the invention to assemble the electrolytic apparatus of individual cells in such a manner that the tightness of the individual cells, the state of the electrical contacts and the distribution of current can be supervised without difficulty. It is further desirable to develop individual cells each of which is operative alone so that they can be readily removed or replaced in the case of a repair being necessary without dismounting the entire electrolytic apparatus and with a short interruption of operation only.

It is a further object of the invention to improve the discharge of chlorine and anolyte, on the one hand, and alkali metal hydroxide solution and hydrogen, on the other, and to construct accordingly the housing of the individual electrolytic cells.

The present invention provides an electrolytic apparatus for the production of chlorine from aqueous alkali metal chloride solution comprising at least one electrolytic cell consisting of a housing with equipment for the supply of the current for the electrolysis, for the supply of the starting products and for the discharge of the products of electrolysis, in which housing the anode and cathode are separated from each other by a separating wall, wherein a. the housing is composed of two hemispherical shells, b. the electrodes are connected within the hemispherical shells by conductive bolts projecting through the wall of the hemispherical shells and the projecting end faces of the bolts are in contact with current supply means and means to clamp together the current supply means, the hemispherical shells, the electrodes and the separating wall, and c. the separating wall is positioned between electrically insulating spacers mounted in the extension of the bolts on the electrolytically active side of the electrodes and clamped between the edges of the hemispherical shells by packing elements.

The cathodes can be made of iron, cobalt, nickel, or chromium, or one of their alloys and the anodes consist of titanium, niobium, or tantalum, or an alloy of these metals, or of a metal-ceramic or oxide-ceramic material. The anodes are covered with an electrically conductive and catalytically active layer containing metals of the platinum group. Due to the shape of the electrodes, which consist of a perforated material, such as perforated plate, metal mesh, braided material, or constructions composed of thin bars of circular cross section, the gases generated in the electrolysis can readily enter the space behind the electrodes. By this gas removal from the electrode gap the resistance generated by the gas bubbles between the electrodes is reduced and, hence, the cell voltage is diminished.

The hemispherical shells can be made of iron, iron alloys, cast iron, or glass fiber reinforced plastic, for example unsaturated polyester resins, chlorinated polyester resins and vinyl ester resins reinforced with glass fibers. Care has to be taken that the hemispherical shell of the anode side is made of a material that is resistant to chlorine.

As separating wall the diaphragms commonly used in alkali metal chloride electrolysis, such as asbestos diaphragms or ion exchange membranes, are suitable. As ion exchange material there may be used, for example, a copolymer of tetrafluoroethylene and a perfluorovinyl ether sulfonic acid of the formula $$-(CF_2CF_2)-\left(\begin{array}{c}CF_2CF\\ |\\ R\end{array}\right)-(CF_2CF_2)-$$

in which

R is $-O-CF_2-CF(CF_3)-O-CF_2-CF_2SO_3H$

The equivalent weight of such ion exchanger membranes are in the range of from 900 to 1,600, preferably 1,100 and 1,500.

Like the asbestos diaphragms the aforesaid ion exchange membranes prevent the hydrogen from mixing with chlorine, but, owing to their selective permeability, they permit the passage of alkali metal ions into the cathode space, i.e. they substantially prevent the halide from passing into the cathode space and the passage of hydroxyl ions into the anode space. Hence, the hydroxide solution obtained is practically free from alkali metal chloride, whereas in the case the alkali metal chloride must be removed from the catholyte by a complicate process. Apart from this and in contradistinction to asbestos diaphragms, ion exchange membranes are dimensionally stable separating walls which are more resistant towards the corrosive media of the alkali metal chloride electrolysis and, therefore, they have a longer service life than asbestos diaphragms.

The electrolytic apparatus according to the invention may consist of one electrolytic cell or of a plurality of series connected cells, in which case the electric contact of adjacent cells is ensured by the conductive bolts.

According to a special embodiment of the electrolysis apparatus of the invention each hemispherical shell is provided with an eye which is in connection with an outlet of the electrolysis space formed by the respective hemispherical shell and the separating wall.

Figure 2:
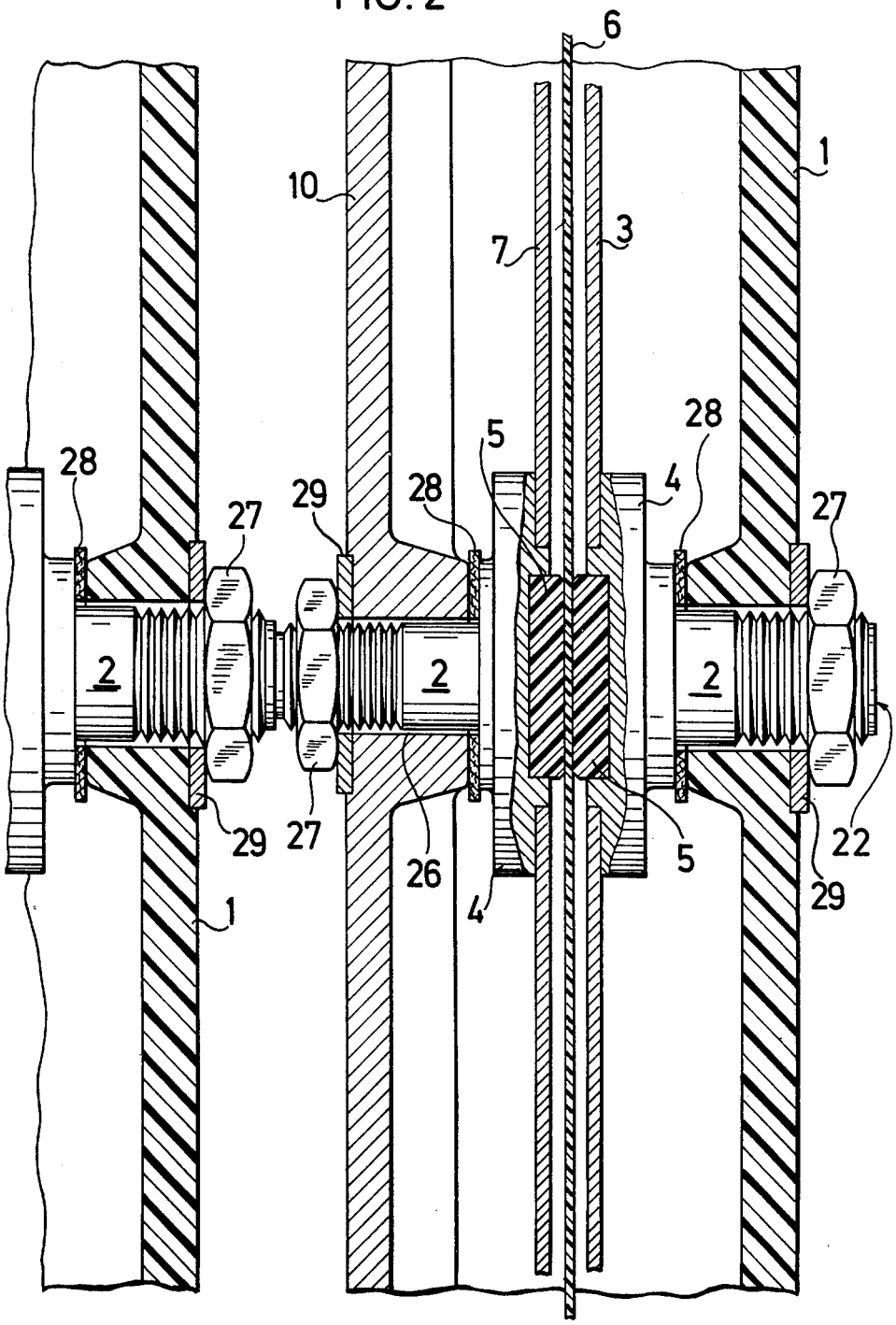
Figure 3:
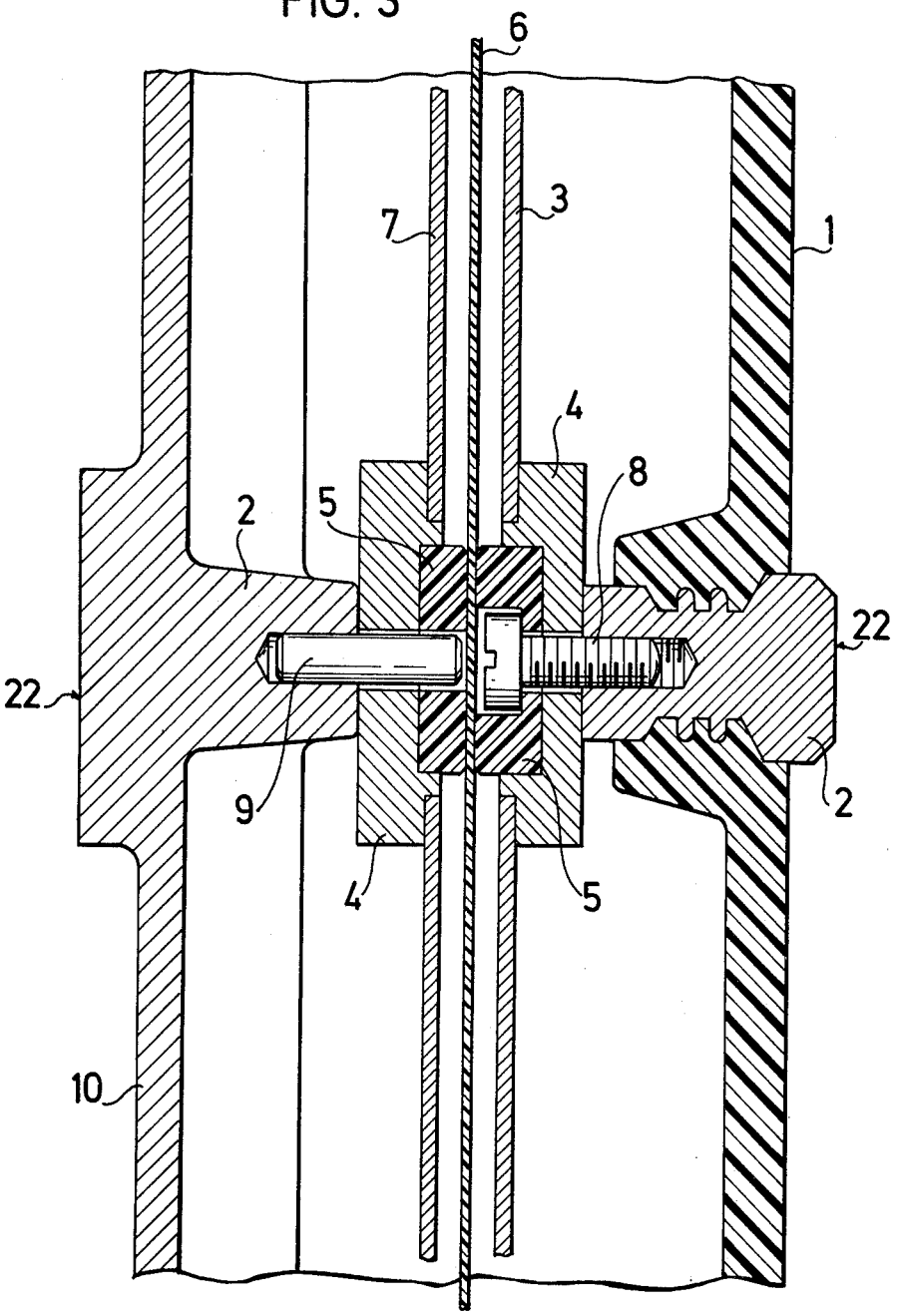
Figure 4:
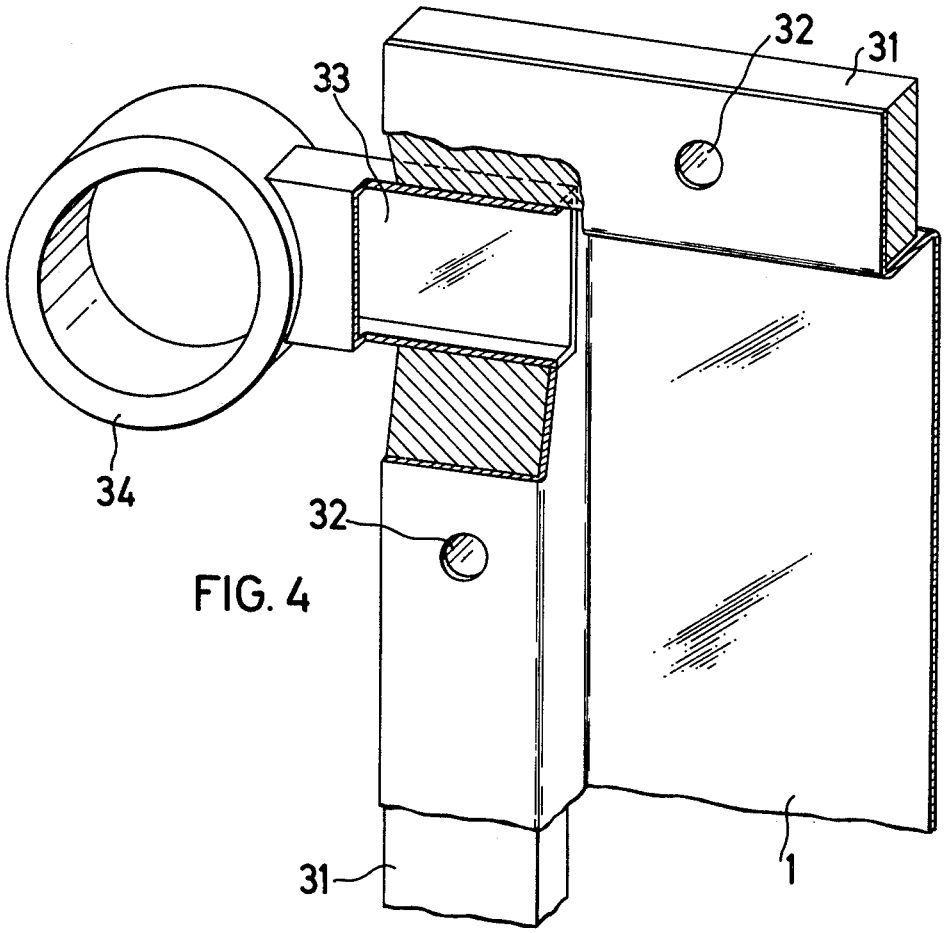
Figure 5:
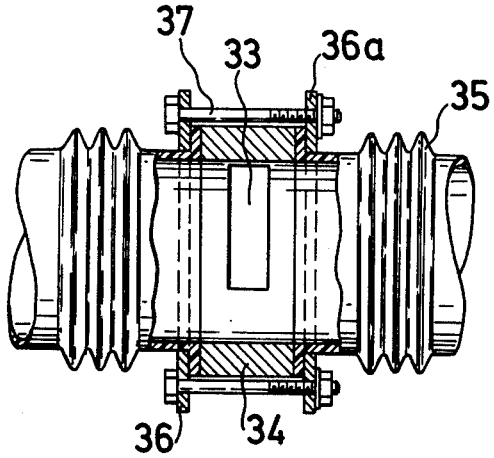

The electrolysis apparatus of the invention will now be described in further detail and by way of example with reference to the accompanying drawing in which FIG. 1 is a cross sectional view of an electrolysis apparatus composed of two electrolytic cells, FIG. 2 illustrates a detail A of FIG. 1 on an enlarged scale, FIG. 3 represents a modification of detail A of FIG. 2, FIG. 4 is a perspective partial view of a hemispherical shell partially broken away, and FIG. 5 illustrates the connection of the electrolysis space with the collecting conduit for chlorine and anolyte or hydrogen and sodium hydroxide solution.

The housing of an electrolytic cell is composed of two hemispherical shells 1 and 10 each provided with flange-like edges 30 between which separating wall 6 is clamped by means of packing elements 14. It is also possible, of course, to clamp the separating wall in different manner. Electrodes 3 and 7 are connected with hemispherical shells 1 and 10 by electrically conductive bolts 2 which project through the wall of the said shells. Current supply means 23 and clamping means 12 rest on the end face 22 of the bolts projecting through the wall of the shell. Clamping means 12 may consist of a U-shaped frame one flange of which is provided with clamping screws 24, while the other flange carries a supporting bolt 25. In extension of bolts 2 electrically insulating spacers 5 are positioned on the electrolytically active side of electrodes 3 and 7. Bolts 2 can be embedded in the two hemispherical shells (FIG. 3) or they are connected with the electrodes (FIG. 2). When the hemispherical shells are made of metal, they can be directly molded on.

To assemble a cell of the constructional elements as shown in FIGS. 1 and 2, bolts 2, which are rigidly connected with electrodes 3 and 7 (by welding, screwing or riveting), are pushed through corresponding openings 26 in the hemispherical shells and the shells are held together by nuts 27 screwed on bolts 2. Numerals 28 and 29 indicate packings to seal bolts 2. In the embodiment shown in FIG. 3, the bolts are embedded in hemispherical shell 1 and molded on hemispherical shell 10. Spacers 5 and electrodes 3 and 7 are connected with the hemispherical shells by screws 8 or plug connections 9. Numeral 4 is intended to indicate an enlargement of electrodes 3 and 7 in this area. The equipped hemispherical shells are provided optionally with spacers 5, packings 14 and separating wall 6, and the flange-like edges 30 are screwed together by screws 13. If desired, the assembled electrolytic cell can now be filled with electrolyte before it is inserted in clamping means 12 with clamping screws 24 tensioned by means of springs 11. The starting products for electrolysis are supplied through inlets 15 and 16. With the use of ion exchange membranes of the aforesaid type, the anode space is charged with alkali metal chloride solution and the cathode space with water or dilute alkali metal hydroxide solution. When microporous flow-type diaphragms are used, for example asbestos diaphragms or diaphragms made of plastic material, the inlet into the cathode space can be dispensed with and alkali metal halide solution is fed to the anode space through the other inlet. Chlorine and hydrogen are discharged through conduits 17 and 18 and conduits 19 and 20 serve to remove the anolyte and catholyte. Numeral 24 indicates insulators.

The flange-like edges 30 at which the hemispherical shells 1 and 10 are screwed together can be reinforced by a frame 31 (FIG. 4). Between the edges a separating wall (not shown) is clamped by means of packings. Perforations 32 receive the screws to screw together the hemispherical shells. The spaces in which electrolysis takes place are formed by hemispherical shells 1 or 10, respectively, and the separating wall, each space contains an electrode. The spaces are fed from below with starting product for the electrolysis, i.e. alkali metal chloride solution for the anode space and water or diluted alkali metal hydroxide solution for the cathode space. Anolyte and halogen and alkali metal hydroxide solution and hydrogen, respectively, are discharged at the head through outlet 33 and passed into eye 34 connected to a collecting pipe 35 (compensators or the like). The connection can be achieved by loose flange rings **36, 36*a* and screws 37. With this type of connection individual electrolytic cells can be easily removed from the entire electrolytic apparatus without complicate dismantling and assembling operations being necessary. This latter type of connection is distinctly more advantageous than the pipework illustrated in FIG. 1.**

In electrolytic apparatus composed of a plurality of electrolytic cells the anode and cathode of adjacent cells are electrically connected via bolts 2, so that the apparatus is a genuine bipolar electrolysis apparatus.

What is claimed is:

1. Electrolytic apparatus for the production of chlorine from aqueous alkali metal chloride solution comprising at least one electrolytic cell consisting of a housing with equipment for the supply of the current for the electrolysis, for the supply of the starting products and for the discharge of the products of electrolysis, in which housing the anode and cathode are separated from each other by a separating wall, wherein a. the housing is composed of two hemispherical shells, b. the electrodes are connected with the hemispherical shells by conductive bolts projecting through the wall of the hemispherical shells and the end faces of the bolts are in contact with current supply means and means to clamp together the current supply means, the hemispherical shells, the electrodes and the separating wall, and c. the separating wall is positioned between electrically insulating spacers mounted in the extension of the bolts on the electrolytically active side of the electrodes and clamped between the edges of the hemispherical shells by packing elements.

2. Electrolytic apparatus as claimed in claim 1, wherein each hemispherical shell is provided at its upper end with an eye which is in connection with an outlet of the electrolytic space formed by the respective shell and the separating wall.

3. Electrolytic apparatus as claimed in claim 1, wherein the cathodes are made of iron, cobalt, nickel, or chromium, or an alloy of any two or more of the said metals.

4. Electrolytic apparatus as claimed in claim 1, wherein the anodes are made of titanium, niobium, tantalum, of an alloy of the said metals, or of a metal-ceramic or oxide-ceramic material and are coated with a conductive, electro-catalytically active coating containing metals or compounds of the metals of the platinum group.

5. Electrolytic apparatus as claimed in claim 1, wherein the hemispherical shells on the anode side are made of a glass-fiber reinforced plastic material that is resistant to chlorine.

6. Electrolytic apparatus as claimed in claim 1, wherein the hemispherical shells on the cathode side are made of a glass-fiber reinforced plastic material resistant to alkali metal hydroxide solutions, or of iron or an iron alloy.

7. Electrolytic apparatus as claimed in claim 6, wherein the shell on the cathode side is made of cast iron.

8. Electrolytic apparatus as claimed in claim 1, wherein an ion exchange membrane is used as separating wall.

9. Electrolytic apparatus as claimed in claim 1, wherein a microporous, flow-type diaphragm is used as separating wall.

* * * * *

UNITED STATES PATENT AND TRADEMARK OFFICE

CERTIFICATE OF CORRECTION

PATENT NO. : 4,029,565

DATED : June 14, 1977

INVENTOR(S) : Bender et al.

It is certified that error appears in the above-identified patent and that said Letters Patent are hereby corrected as shown below:

In the Heading, Item [73] change "Hoeschst" to --Hoechst--.

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*